United States Patent [19]

Pemberton

[11] Patent Number: 4,688,672

[45] Date of Patent: Aug. 25, 1987

[54] GAGING RACK FOR HOLDING WRENCH SOCKETS

[76] Inventor: J. C. Pemberton, 9920 Sunset Ave., La Mesa, Calif. 92154

[21] Appl. No.: 807,752

[22] Filed: Dec. 11, 1985

[51] Int. Cl.[4] ..... B65D 85/02; A47G 29/00

[52] U.S. Cl. ..... 206/378; 206/493; 211/70.6

[58] Field of Search ..... 206/349, 372, 373, 376–379, 206/493; 211/70.6; 312/DIG. 33

[56] References Cited

U.S. PATENT DOCUMENTS

| | | | |
|---|---|---|---|
| 434,780 | 8/1890 | Hescox | 206/379 |
| 1,712,473 | 8/1927 | McWethy . | |
| 3,405,377 | 3/1967 | Pierce . | |
| 3,583,556 | 6/1971 | Wagner | 206/373 |
| 3,726,393 | 4/1973 | Thompson . | |
| 4,062,137 | 12/1977 | Herzog | 211/59.1 |
| 4,337,860 | 7/1982 | Carrigan . | |
| 4,353,465 | 10/1982 | Rado . | |
| 4,421,230 | 12/1983 | Stanton | 206/378 |
| 4,621,738 | 11/1986 | Delucchi | 211/70.6 |

*Primary Examiner*—Stephen Marcus
*Assistant Examiner*—Jimmy G. Foster
*Attorney, Agent, or Firm*—Jessup, Beecher & Slehofer

[57] ABSTRACT

A gaging and storage rack for wrench sockets consisting of a base and a plurality of posts projecting upwardly therefrom. Each post is composed of two sections: a lower section adapted to receive a particular size of socket, and an upper section of uniform size adapted to receive and project above the drive hole in the socket. Associated with each post is a marking of the dimension or size of the socket which the lower section is adapted to receive.

6 Claims, 4 Drawing Figures

GAGING RACK FOR HOLDING WRENCH SOCKETS

This invention relates to a receptacle or rack for holding fasteners, specifically sockets used as a component of a socket wrench.

BACKGROUND OF THE INVENTION

A tool which is widely used by mechanics, for example automobile mechanics, consists of a set of sockets or socket wrenches, each having at one end a uniform drive hole adapted to receive a wrench handle, and at the other end a nut-receiving socket, often with 12 points, adapted to fit over a particular size hex nut. Various forms of containers or holders for the typical sequence of sockets are in use, ranging upward in sophistication from a simple tapered channel adapted to receive the sockets in graduated size. It is an object of this invention to provide an improved socket holder or rack in which the sockets may be easily and quickly stored in sequential order, and accurately and speedily retrieved with minimum loss of time hunting for the desired socket size.

BRIEF SUMMARY OF THE INVENTION

The invention consists of a rack or base with a plurality of posts or studs extending upward therefrom. The posts have a lower section of sequentially graduated size, adapted to selectively receive a particular size of socket. The upper section of each post is of uniform size and protrudes through the drive hole in the socket. Each post has associated therewith a marking of the dimension or size of the socket received over the post. The socket is stored on the post with the driven end up and the selective-size-end down, slip fitted over the lower section of the post. Thus, a user may quickly select the correct size of socket by reading the size from the adjacent, associated marking. Alternatively, if working in cramped positions, as underneath an automobile, a mechanic may simply feel along the row of sockets, counting up or down, and knowing the arrangement of the sockets, until he comes to the appropriate size, and then lift it off the post.

The structure of this invention also makes it easy to store the sockets on the rack, because each post serves as a socket gage, and will not accept sockets that are smaller than the desired size. Therefore a mechanic may quickly store the sockets in the proper order by trying a post that is slightly larger than the socket and working quickly down until the socket in his hand slips easily over the proper post.

The invention also provides for the temporary mounting of a socket on its post by turning it upside down and mounting the drive hole in the socket over the upper section of the post. The socket thus protrudes above the level of the other sockets and may be quickly retrieved by a mechanic who is using that particular socket a great deal of time. He need only move along tactilely or visually until he encounters the proper upended socket projecting above its post. He then lifts that socket off the post, knowing that is the one which he is using at the time. When the job is over, he reverses the attitude of the socket, and mounts it, driven end up, with the working end of the socket slip fitted over its correct post.

DETAILED DESCRIPTION

Figure 1:
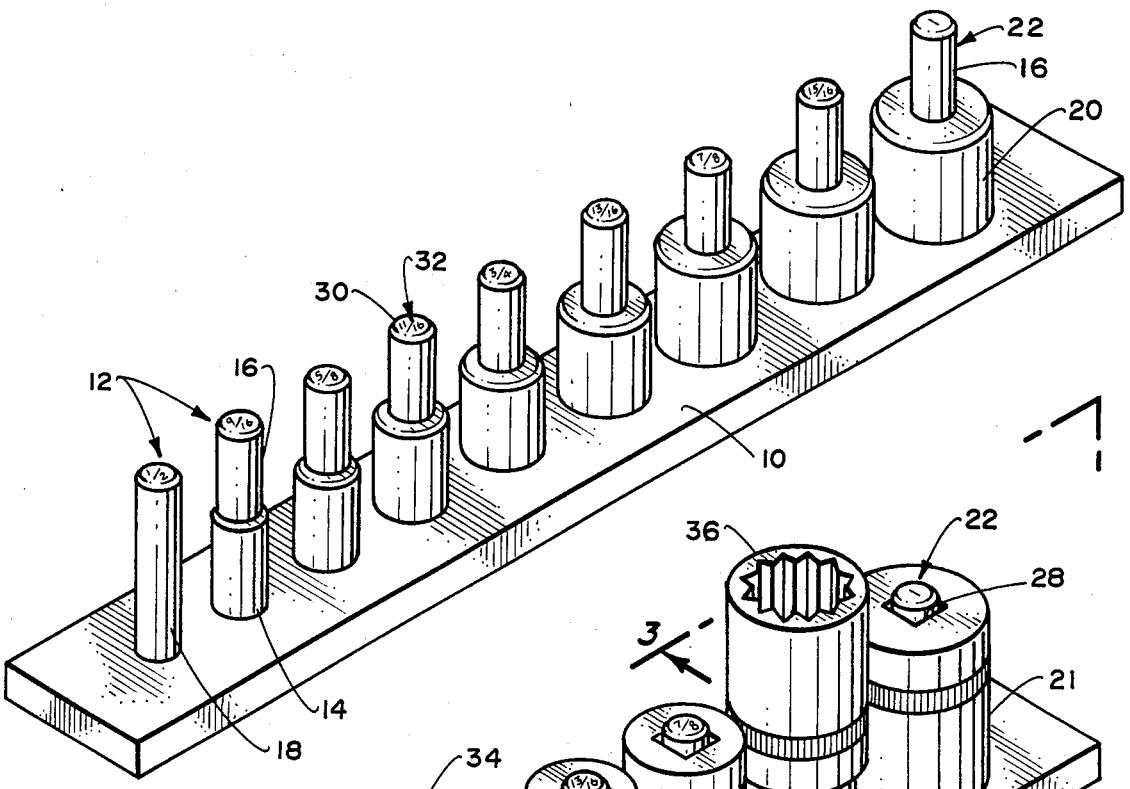
FIG. 1 is an isometric view of a socket wrench constructed in accordance with the invention, without any sockets mounted thereon.

A preferred embodiment of the invention is shown in the drawings, wherein 10 is a substantially flat, elongate base, having a plurality of posts 12 projecting upwardly therefrom. Each post comprises, axially aligned, a first, substantially cylindrical lower section 14 adjacent to base 10, and a second, upper section 16, remote from the base 10. The upper sections 16 of the posts 12 are substantially uniform in size. The lower sections 14 are of progressively increasing diameter or cross-sectional area, ranging from the post 18 where the lower section is the same size as the upper section, to the post section 20 where the lower section is much larger than the upper section. The section 18 receives the smallest socket 19; the section 20 receives the largest socket 21.

Figure 3:
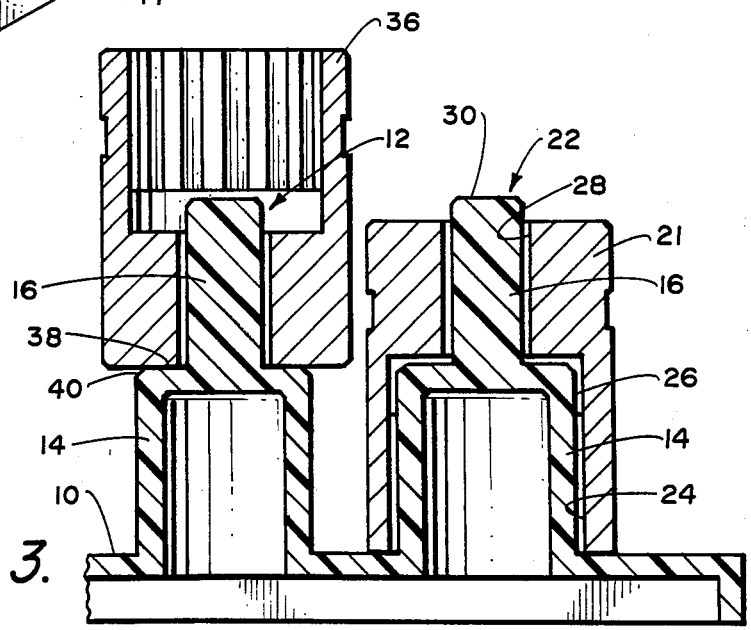
FIG. 3 is a partial sectional view taken on line 3—3 of FIG. 2.

The lower section 14 of each socket post 12 has a maximum cross-sectional dimension corresponding to a given socket size. In the example shown, the lower section 14 consists of a right circular cylinder whose diameter corresponds to the size of a given socket. Smaller sockets will not fit over that post and larger sockets will be quite loose. As shown in FIG. 3, the socket or recess at the working or non-driven end of each socket, shown at 24, is of such size as to fit snuggly with a slip fit over the circumference 26 of the lower section 14 of the post 22. The upper section 16 of the post 22 is sized to fit readily through the drive hole 28 of the socket 21. All of the drive holes 28 are of uniform size.

Associated with each post 12 is a marking indicating the size of the socket 19/21 which the particular post is adapted to receive. In the embodiment shown in FIGS. 1 and 2, the upper end of each post 12 projects through the socket drive hole 28, and on the top 30 is embossed or engraved a marking of the size or dimension 32 of the socket 21 adapted to be fitted over that particular post.

Figure 2:
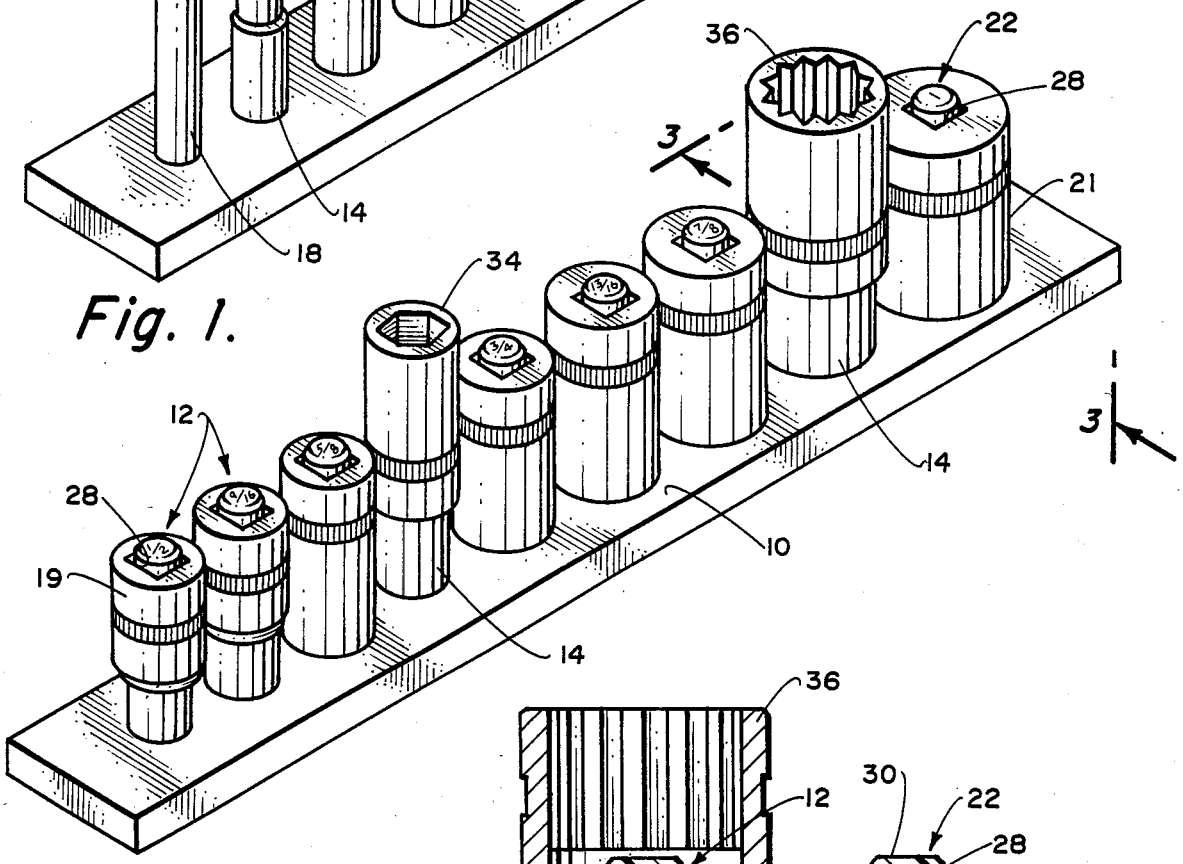
FIG. 2 is a view similar to FIG. 1 showing sockets mounted on the rack in the two attitudes contemplated by this invention.
Figure 4:
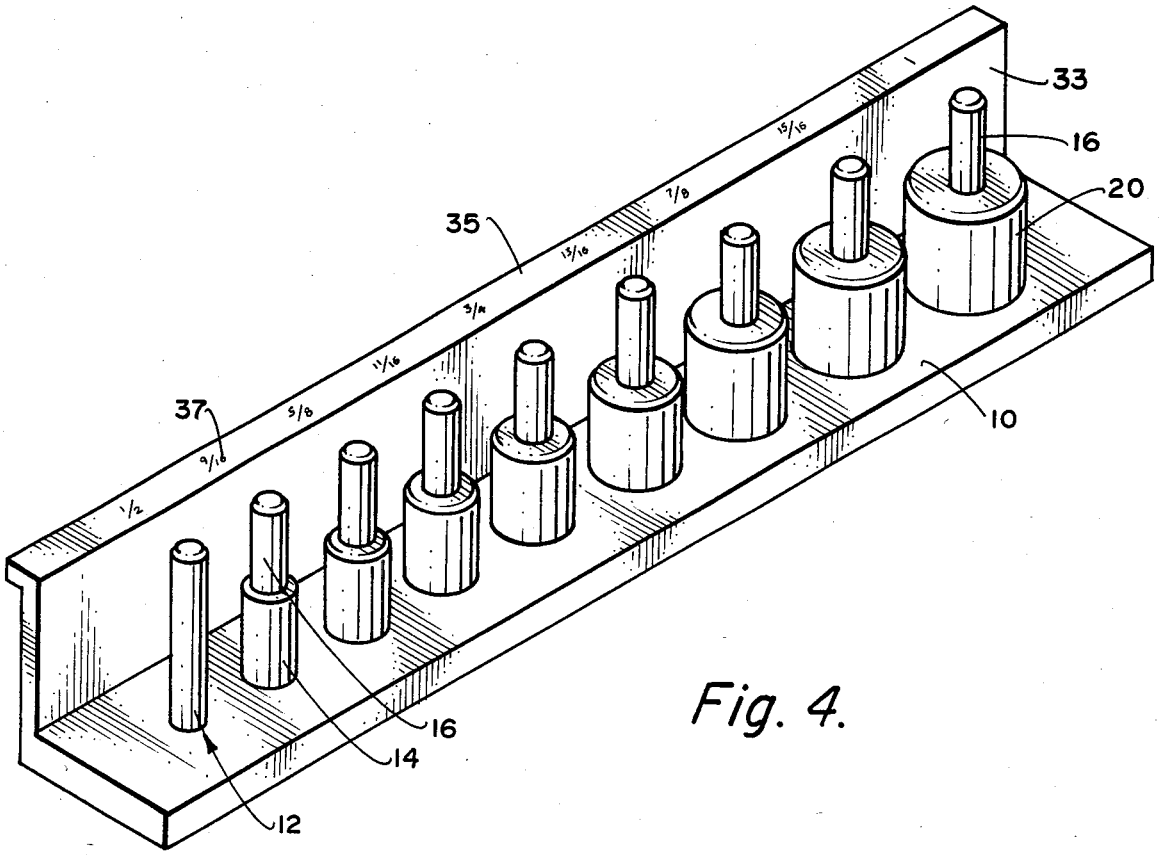
FIG. 4 is a view similar to FIG. 1 showing another embodiment of the invention.

The FIG. 1 embodiment illustrates a rack adapted to receive sockets with drive holes 28 which are $\frac{1}{2}$ inch square. For smaller drive-hole sockets, e.g. $\frac{1}{4}$ inch, the post sections 16 are so small that the area 30 seriously restricts the size of the marking 32. For such a rack, a panel or side board 33, shown in FIG. 4, may be provided, co-extensive with the row of posts 12. The panel 33 is secured to or formed integral with the base 10. The upper edge 35 of panel 33 is provided with size markings 37 adjacent the corresponding post 12, in lieu of the top post markings 32 of FIG. 1.

On occasion a mechanic working on a piece of machinery or apparatus will have repeated need for certain size sockets. In such case, having determined these sizes, shown for example at 34 and 36 in FIG. 2, he places the sockets, driven end down, over the upper section 16 of the post. Each socket rests on the shoulder 38, forming the junction between the lower section 14 and the upper section 16 of the post. The two selected sockets 34 and 36 thus project above the level of the other sockets and may be readily retrieved and replaced by the user as he works on the machine. By use of the technique shown in FIG. 2, the two desired and much-used sockets 34 and 36 may be readily retrieved by the user, tactilely without even having to look at the sockets.

As shown, it is preferred to align the posts in sequentially and prograssively increasing size, although any other arrangement of the posts may be employed. As noted, it is preferred, for ease of manufacture and optimal use, to make both of the post sections 14 and 16 as right circular cylinders, although this is not essential.

It is desirable, although not essential, to chamfer the junction between the two post sections 14 and 16 at the shoulder 38, as shown at 40. This facilitates the placement of a socket 21 over the post section 14.

In use, if the user has taken a number of sockets off the rack, they are readily replaced by employing the rack as the socket gage. The user tries a first post 14 which appears to be the right size. If the socket does not drop over the post, the user then tries a next smaller post. If the socket is obviously too large for the post, he moves up the line until he finds a post section 14 over which the socket provides a snug, but easy, slip fit.

The provision of the size marking on the top 30 of the posts 12, or the upper edge 35 of the panel 33, makes it easy to quickly wipe off the tops, so that they may be easily wiped free of grease, and the numbers readily discerned.

What is claimed is:

1. Gaging and storage rack for sockets for a socket wrench comprising:

in combination with a plurality of sockets having working recesses of progressively increasing size at one end and substantially uniform drive holes at the other end;

a base;

a plurality of posts projecting from said base, each post comprising, axially aligned:

a first substantially cylindrical section adjacent said base having a maximum cross sectional dimension corresponding to a given socket size, said posts having said first sections of progressively increasing size and being arranged along a line in order of progressively increasing cross sectional dimension; and a second section remote from said base and having a projecting end of cross section small enough to project through the drive hole in the socket;

the working recesses of said sockets residing in a snug but slip fit around said first sections;

the said projecting ends being of sufficient length to retain the sockets when reversed with the drive hole ends placed over said second sections.

2. Rack in accordance with claim 1 having, associated with the posts, markings identifying the associated post by the size of the socket which the first section is adapted to receive.

3. Rack in accordance with claim 2, wherein the projecting end of each said second section is marked with the size of the socket which the first section is adapted to receive.

4. Rack in accordance with claim 2 including a panel extending from said base substantially co-extensive with said posts, said markings being on said panel, each marking being adjacent the post whose size is indicated by the particular marking.

5. Rack in accordance with claim 1 wherein:

said first section is a right circular cylinder.

6. Rack in accordance with claim 1, wherein said size is embossed or engraved.

* * * * *